US011486620B2

(12) United States Patent
Ishiyama et al.

(10) Patent No.: US 11,486,620 B2
(45) Date of Patent: Nov. 1, 2022

(54) REFRIGERATION CYCLE APPARATUS

(71) Applicant: Mitsubishi Electric Corporation, Tokyo (JP)

(72) Inventors: Hiroki Ishiyama, Tokyo (JP); Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 237 days.

(21) Appl. No.: 16/464,725

(22) PCT Filed: Jan. 25, 2017

(86) PCT No.: PCT/JP2017/002487

§ 371 (c)(1),
(2) Date: May 29, 2019

(87) PCT Pub. No.: WO2018/138796

PCT Pub. Date: Aug. 2, 2018

(65) Prior Publication Data

US 2019/0346182 A1 Nov. 14, 2019

(51) Int. Cl.
*F25B 49/02* (2006.01)
*F25B 31/00* (2006.01)

(52) U.S. Cl.
CPC ..... *F25B 49/02* (2013.01); *F25B 31/002* (2013.01); *F25B 2400/01* (2013.01);
(Continued)

(58) Field of Classification Search
CPC ..... F25B 2400/01; F25B 2700/21155
See application file for complete search history.

(56) References Cited

U.S. PATENT DOCUMENTS 3,878,112 A * 4/1975 Luck ..... C10M 171/008 252/68
4,638,643 A * 1/1987 Sakazume ..... F25B 49/025 318/436

(Continued)

FOREIGN PATENT DOCUMENTS

CN 102933848 A 2/2013
EP 2 578 880 A1 4/2013

(Continued)

OTHER PUBLICATIONS

Office Action dated May 12, 2020 issued in correspondin JP patent application No. 2018-563985 ( and English translation).

(Continued)

*Primary Examiner* — Christopher R Zerphey
(74) *Attorney, Agent, or Firm* — Posz Law Group, PLC

(57) ABSTRACT

In a refrigeration cycle apparatus, refrigerant circulates successively through a compressor, a condenser, an expansion valve, and an evaporator. The refrigeration cycle apparatus includes a detection unit, a heating unit, and a controller. The detection unit is configured to detect a temperature of refrigeration oil in the compressor. The heating unit is configured to heat the refrigeration oil. The controller is configured to operate the heating unit when the temperature detected by the detection unit is lower than a pour point of the refrigeration oil, and to stop the heating by the heating unit when the temperature detected by the detection unit reaches the pour point. Preferably, the heating unit includes a heater provided on an outer side of a compressor casing and at a lower portion of a motor unit.

6 Claims, 10 Drawing Sheets

(52) U.S. Cl.
CPC ..... *F25B 2500/16* (2013.01); *F25B 2500/31* (2013.01); *F25B 2700/21155* (2013.01)

(56) References Cited

U.S. PATENT DOCUMENTS

| | | | | |
|---|---|---|---|---|
| 9,939,184 | B2 * | 4/2018 | Yura | F25B 49/02 |
| 2012/0023984 | A1 | 2/2012 | Sakai et al. | |
| 2012/0227430 | A1 * | 9/2012 | Takeuchi | F25B 49/02 62/228.1 |
| 2013/0112392 | A1 * | 5/2013 | Karpinski | F28F 27/00 165/300 |
| 2014/0230476 | A1 | 8/2014 | Yura et al. | |
| 2016/0018148 | A1 | 1/2016 | Yura | |

FOREIGN PATENT DOCUMENTS

| | | | | |
|---|---|---|---|---|
| EP | 2578880 | A1 * | 4/2013 | F04C 29/028 |
| EP | 2578880 | A1 | 4/2013 | |
| EP | 2966380 | A1 | 1/2016 | |
| JP | S54-59552 | A | 4/1979 | |
| JP | S59-217453 | A | 12/1984 | |
| JP | S60-243436 | A | 12/1985 | |
| JP | S62-098158 | A | 5/1987 | |
| JP | H03-122459 | A | 5/1991 | |
| JP | H07-035957 | U | 7/1995 | |
| JP | 2006-145071 | A | 6/2006 | |
| JP | 2008-209036 | A | 9/2008 | |
| JP | 2010-014349 | A | 1/2010 | |
| JP | 4438610 | B2 | 1/2010 | |
| JP | 2010-151388 | A | 7/2010 | |
| JP | 2010-210208 | A | 9/2010 | |
| JP | 2012-189240 | A | 10/2012 | |
| JP | 5084714 | B2 | 11/2012 | |
| JP | 2012-251713 | A | 12/2012 | |
| JP | 2014-173791 | A | 9/2014 | |
| WO | 2011/155175 | A1 | 12/2011 | |

OTHER PUBLICATIONS

International Search Report of the International Searching Authority dated Apr. 25, 2017 for the corresponding International application No. PCT/JP2017/002487 (and English translation).

Office Action dated Sep. 25, 2020 issued in corresponding CN patent application No. 201780083740.8 (and English machine translation).

Office Action dated Nov. 10, 2020 issued in corresponding JP patent application No. 2018-563985 (and English machine translation).

Office Action dated May 7, 2021 issued in corresponding CN patent application No. 201780083740.8 (and English machine translation).

Partial Supplementary European Search Report dated Dec. 3, 2019 issued in corresponding EP patent application No. 17894375.9.

Office Action dated Jun. 1, 2021 issued in corresponding JP patent application No. 2018-563985 (and English machine translation).

Office Action dated Sep. 24, 2021 issued in counterpart CN application No. 201780083740.8 (and English Machine Translation).

Office Action dated Dec. 7, 2021 issued in corresponding EP patent application No. 17894375.9.

* cited by examiner

REFRIGERATION CYCLE APPARATUS

CROSS REFERENCE TO RELATED APPLICATION

This application is a U.S. national stage application of PCT/JP2017/002487 filed on Jan. 25, 2017, the contents of which are incorporated herein by reference.

TECHNICAL FIELD

The present invention relates to refrigeration cycle apparatuses, and particularly to a refrigeration cycle apparatus capable of improving the fluidity of refrigeration oil at low temperature.

BACKGROUND ART

There is a need for increased operating range, such as to adapt to cold climate regions. One of the concerns for increased operating range is the lubricity of refrigeration oil of a compressor.

Variation in viscosity of lubricant causes variation in viscosity resistance of a slider of a compressor. Thus, it is known that a compressor exhibits such characteristic that compressor input is small when the compressor temperature is relatively high during summer months, and compressor input is great when the compressor temperature is relatively low during winter months.

Japanese Patent Laying-Open No. 59-217453 (PTL 1) discloses a refrigeration apparatus consisting of a compressor, a condenser, a throttle device, an evaporator and the like which are successively connected together, in which the condenser and the compressor are forcibly cooled by a fan. There are provided a first refrigerant circuit having a solenoid valve between the compressor and the condenser, and a second refrigerant circuit, in parallel with the first refrigerant circuit, having a resistance tube and a lubricant heating pipe of the compressor connected in series. The solenoid valve and the fan are controlled by a thermostat device to detect a lubricant temperature directly or indirectly.

CITATION LIST

Patent Literature

PTL 1: Japanese Patent Laying-Open No. 59-217453

SUMMARY OF INVENTION

Technical Problem

When the temperature of refrigeration oil in a compressor (hereinafter referred to as oil temperature) is at or below the pour point, however, several problems occur in the following respects. First, when the oil temperature is at or below the pour point, the refrigeration oil in the compressor increases in viscosity, causing an increase in driving torque, resulting in a motor current value of the compressor reaching overcurrent. Accordingly, the compressor stops abnormally, and air conditioning and the like can no longer be performed, resulting in reduced user comfort. In this case, there will be an insufficient oil supply to a bearing and the like of the compressor, possibly causing failure due to poor lubrication, resulting in reduced reliability of a refrigeration cycle apparatus.

Second, when the oil concentration in refrigerant in a compressor is not uniform but varies (for example, when two-phase separation has occurred between the refrigerant and refrigeration oil), the refrigeration oil having a high viscosity in the compressor may be present around a motor, causing an increase in driving torque, resulting in the compressor reaching overcurrent in a manner similar to the above. Accordingly, there are concerns for an abnormal stop and reduced comfort. For example, when concentration distribution occurs in a liquid membrane formed between a shaft and a bearing, the refrigeration oil having a high viscosity does not circulate, so that stress is concentrated at one point, causing an increase in surface pressure of that location. The increased surface pressure causes wear to occur, or causes an increased amount of eccentricity which results in a reduced thickness of the liquid membrane and wear at other locations, for example, thus reducing the reliability of the compressor.

An object of the present invention is to provide a refrigeration cycle apparatus capable of maintaining an appropriate viscosity of refrigeration oil.

Solution to Problem

The present disclosure is directed to a refrigeration cycle apparatus in which refrigerant circulates successively through a compressor, a condenser, an expansion valve, and an evaporator. The refrigeration cycle apparatus includes a detection unit, a heating unit and a controller. The detection unit is configured to detect a temperature of refrigeration oil in the compressor. The heating unit is configured to heat the refrigeration oil. The controller is configured to operate the heating unit when the temperature detected by the detection unit is lower than a pour point of the refrigeration oil, and to stop the heating by the heating unit when the temperature detected by the detection unit reaches the pour point.

Advantageous Effects of Invention

According to the present invention, an appropriate viscosity of refrigeration oil is maintained, so that the reliability of a refrigeration cycle apparatus under low temperature is improved.

DESCRIPTION OF EMBODIMENTS

Figure 1:
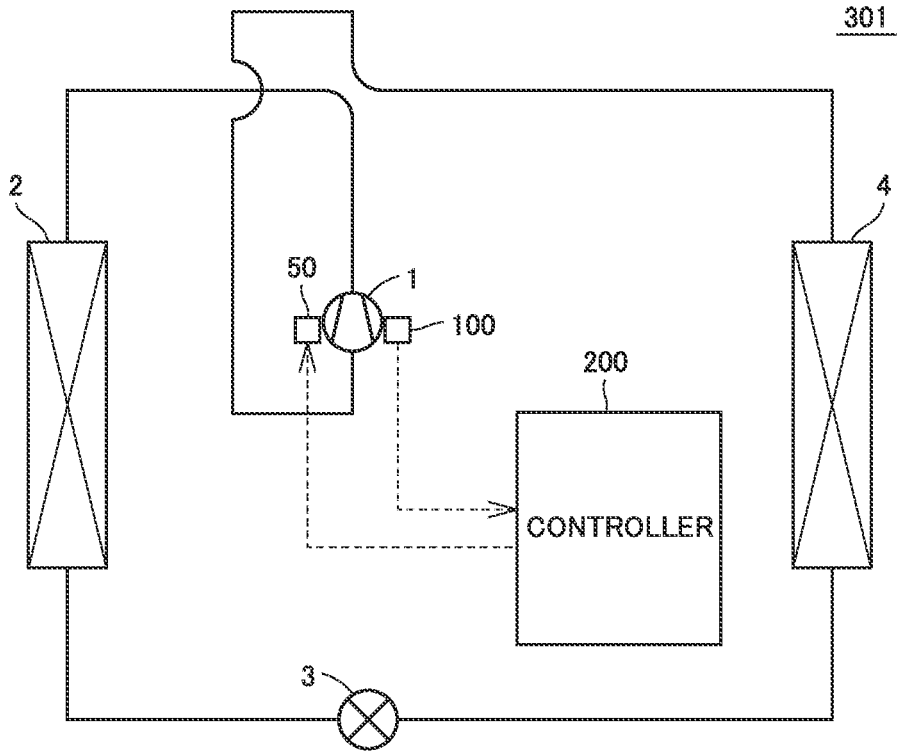
FIG. 1 shows a configuration of a refrigeration cycle apparatus according to a first embodiment.

In the following, embodiments of the present invention will, be described in detail with reference to the drawings. Although a plurality of embodiments are described below, it has been intended from the time of filing of the present application to appropriately combine configurations described in the respective embodiments. It should be noted that the same or corresponding parts are designated by the same symbols in the drawings and will not be described repeatedly.

Definition of Terms

With regard to a compressor and refrigeration oil, terms are defined as follows in embodiments. A temperature at which liquid does not flow at all is referred to as a freezing point, and a temperature immediately before the freezing point is referred to as a "pour point." The pour point, which varies with the type or concentration of refrigeration oil, is −37.5° C. at a very low temperature and for Daphne Hermetic Oil (registered trademark), for example. An "amount of oil" refers to an amount of refrigeration oil to be heated. A "motor current value" refers to a current value of a motor for driving the compressor.

First Embodiment

A first embodiment pertains to a refrigeration cycle apparatus to detect that the temperature of refrigeration oil of a compressor is at or below the pour point and to heat the refrigeration oil. FIG. 1 shows a configuration of the refrigeration cycle apparatus according to the first embodiment. Referring to FIG. 1, a refrigeration cycle apparatus 301 includes a compressor 1, a condenser (high-pressure-side heat exchange) 2, an expansion valve (decompressing device) 3, an evaporator (low-pressure-side heat exchanger) 4, a pour point determination sensor 100, a heating, unit 50, and a controller 200.

High-temperature and high-pressure refrigerant discharged from compressor 1 flows into a refrigerant passage of condenser 2. Low-temperature and low-pressure refrigerant that has passed through condenser 2 and expansion valve 3 flows into a refrigerant passage with purification function. Pour point determination sensor 100 can detect that the temperature of refrigeration oil in compressor 1 reaches a point equal to or below the pour point. A temperature sensor capable of detecting a compressor shell temperature can be used, for example, as pour point determination sensor 100. Heating unit 50 increases the temperature of the refrigeration oil. Based on a detection value from pour point determination sensor 100, controller 200 controls heating unit 50 and each actuator (for example, an operating frequency of the compressor, a degree of opening of expansion valve 3, and the like).

Figure 2:
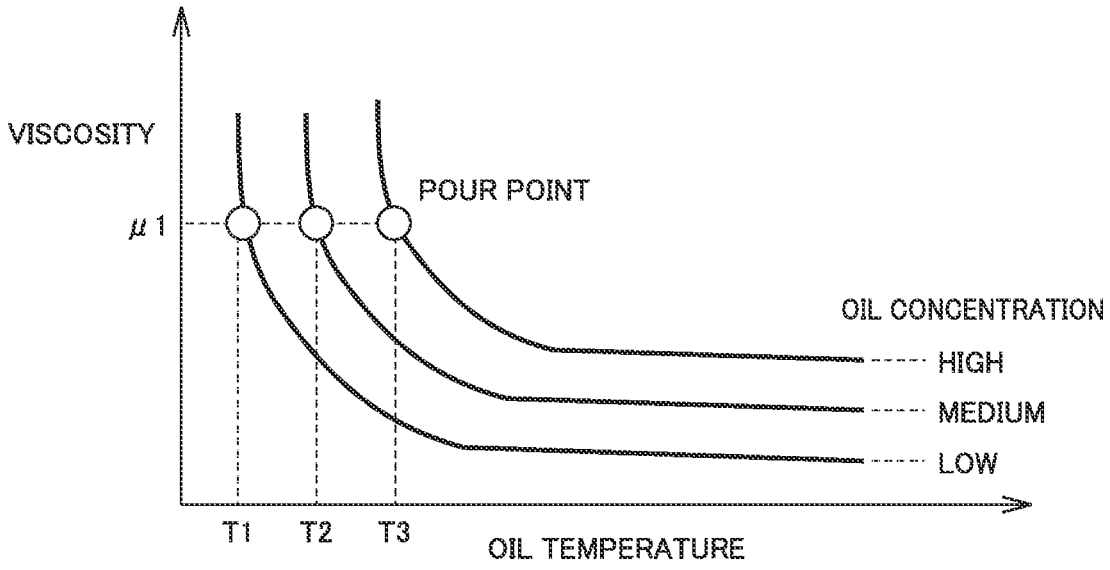
FIG. 2 illustrates relation between pour point and oil temperature.

FIG. 2 illustrates relation between pour point and oil temperature. When oil concentration is low, the pour point is a temperature T1. When oil concentration is medium, the pour point is a temperature T2. When oil concentration is high, the pour point is a temperature T3. It should be noted that a relation of T1<T2<T3 holds.

When the oil temperature decreases, the oil has a viscosity μl at the pour point. When the oil temperature falls below the pour point, the viscosity increases suddenly, and the refrigeration oil loses the fluidity.

With regard to the pour point, when means for detecting the oil concentration is not provided, a previously stored pour point under the most stringent condition (oil concentration: high) is used as a value for determining the pour point. Even if there is variation in the concentration, the viscosity is reduced and the fluidity is improved by heating. Therefore, by uniformly heating mixed liquid within the compressor to the pour point when the oil concentration is high (temperature T3), the refrigeration oil in the compressor can reach a point equal to or above the pour point.

Figure 3:
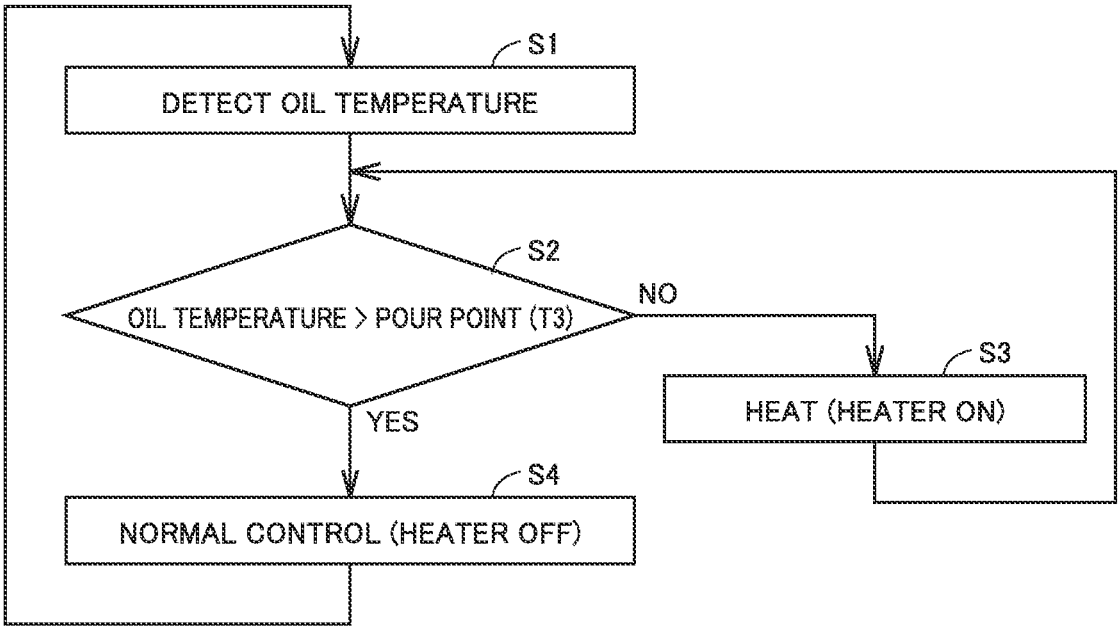
FIG. 3 is a flowchart illustrating control performed in the refrigeration cycle apparatus of the first embodiment.

FIG. 3 is a flowchart illustrating control performed in the refrigeration cycle apparatus of the first embodiment. Referring to FIGS. 1 and 3, in step S1, controller 200 causes sensor 100 to detect the temperature of the refrigeration oil. Then, in step S2, controller 200 determines which of the current oil temperature and the pour point is higher/lower.

When the current oil temperature≤the pour point holds in step S2 (NO in S2), the process proceeds to step S3, where controller 200 causes heating unit 50 to heat the refrigeration oil within compressor 1. Since the temperature of the refrigeration oil at this time is at or below the pour point, the refrigeration oil is in a coagulated state, and thus the motor of compressor 1 is not rotating.

When the oil temperature>the pour point holds in step S2 (YES in S2), on the other hand, normal control is performed. In the normal control, the heating by heating unit 50 is stopped and the motor of compressor 1 is operated, so that the refrigerant circulates through the refrigerant circuit.

Flow of Refrigerant and Oil

When controller 200 detects by sensor 100 that the refrigeration oil temperature is at or below the pour point, controller 200 causes heating unit 50 to heat the refrigeration oil. At this time, controller 200 stops working units (a motor and a solenoid valve serving as actuators) in order to prevent overcurrent caused by friction or increased torque.

When the temperature of the refrigeration oil is increased by heating unit 50, the oil viscosity is reduced. Once the temperature of the refrigeration oil is increased and the oil viscosity is reduced, controller 200 drives each actuator. In addition, when variation occurs in the oil concentration in the compressor (for example, when two-phase separation occurs between the oil and the refrigerant), the oil concentration variation can be reduced by uniformly heating the liquid refrigerant in the compressor.

According to the refrigeration cycle apparatus of the first embodiment, the following effects are obtained. First, by controlling the compressor at an oil temperature higher than the pour point, an increase in driving torque of the compressor is suppressed, so that the reliability of the compressor can be improved. Second, by controlling the working units of compressor 1 after increasing the oil temperature to a temperature higher than the pour point, an abnormal stop of the compressor due to overcurrent caused by increased driving torque of compressor 1 is avoided, so that the reliability can be improved. Third, when variation in the oil concentration such as two-phase separation occurs in the compressor, the variation is reduced by uniformly heating the liquid refrigerant in the compressor, so that the compressor reliability can be improved.

Arrangement Examples of Heating Unit

Several arrangement examples of heating unit 50 provided on compressor 1 are illustrated below. An electric heater can be used as heating unit 50. The position of the heater is generally at the bottom of compressor 1. An example compressor has a hollow rotating shaft, and is configured such that refrigeration oil is pumped through the shaft from the bottom of the compressor to the upper portion of a motor due to a pressure difference in the compressor. In such a compressor, the pumped oil drops from the upper portion of the motor to the bottom of the compressor by gravity, then circulates. Accordingly, possible locations where the refrigeration oil tends to remain include the upper portion and also the lower portion of the motor. The heater may be installed on the inner side or the outer side of a casing at each of the upper portion and the lower portion of the motor. It should be noted that the arrangement of the motor, the manner of flow of the oil, the manner of pumping the oil and the like in compressor 1 vary with the type of a compressor. Thus, the followings are merely examples and other arrangements may be employed.

Figure 4:
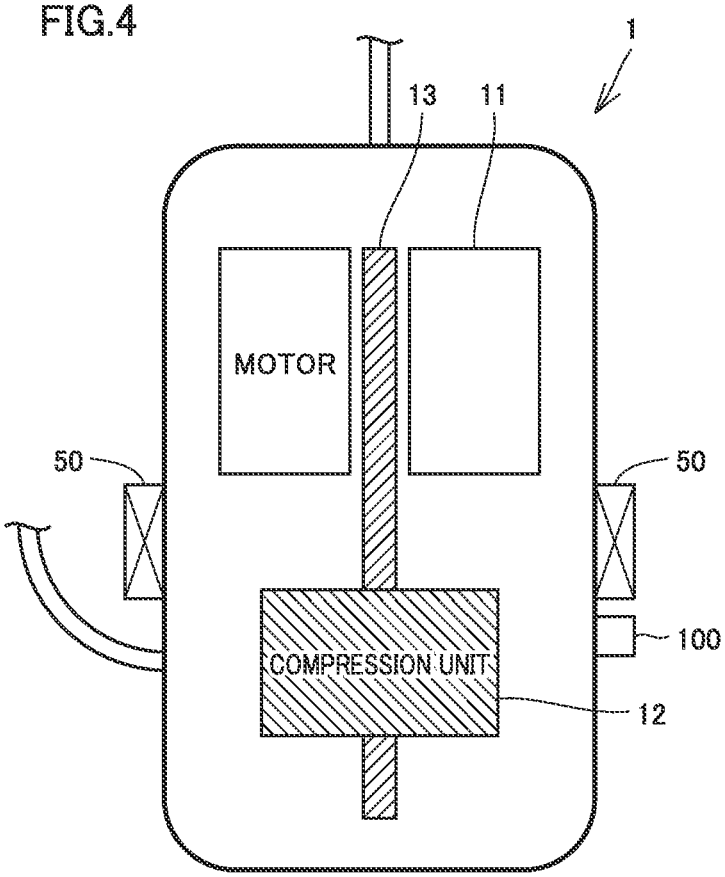
FIG. 4 shows a first example of arrangement of a heater.

FIG. 4 shows a first example of arrangement of the heater. Compressor 1 has a motor 11 and a compression unit (a pump unit to compress and discharge the refrigerant) 12 contained in the casing. The portion where motor 11 is arranged Will be referred to as a motor unit. In compressor 1 shown in this first example, heating unit 50 is installed at the lower portion of the motor unit and outside the casing. When motor 11 is arranged above compression unit 12, heating unit 50 is arranged between compression unit 12 and motor 11.

In a compressor having such an arrangement, the refrigeration oil may remain at a lower end portion of motor 11 while the compressor is stopped. When the temperature of the refrigeration oil in the compressor reaches a point equal to or below the pour point, the location where a large amount of refrigeration oil remains (motor lower end portion) is heated. To monitor the heating temperature, sensor 100 is preferably installed at the location where the refrigeration oil remains. The refrigeration oil in the compressor is thereby uniformly heated. Accordingly, the viscosity of most of the refrigeration oil in the compressor can be reduced, so that the reliability can be improved. In addition, when variation in the oil concentration such as two-phase separation occurs in the compressor, the variation is reduced by the uniform heating, so that the compressor reliability can be improved.

Figure 5:
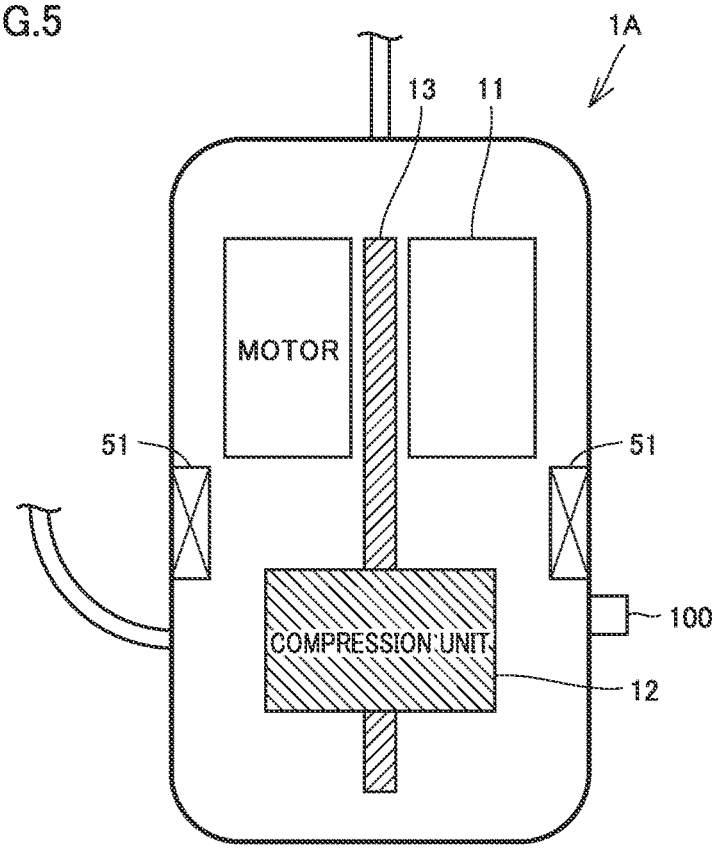
FIG. 5 shows a second example of arrangement of the heater.

FIG. 5 shows a second example of arrangement of the heater. In a compressor 1A shown in this second example, heating unit 51 is installed at the lower portion of the motor unit and inside the casing. The refrigeration oil remains in a manner similar to the first example.

In the second example, the heater is arranged in the refrigeration oil within compressor 1A. Accordingly, the oil can be directly heated, so that power consumption can be suppressed. In addition, the direct heating of the oil can shorten the time to reach a target temperature, thus permitting an early start of heating.

Figure 6:
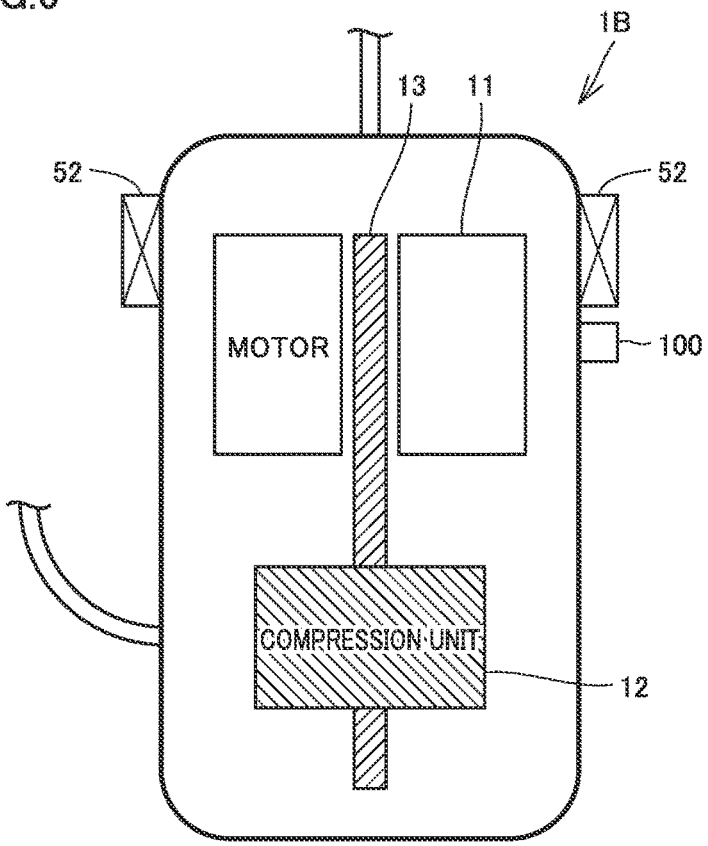
FIG. 6 shows a third example of arrangement of the heater.
Figure 7:
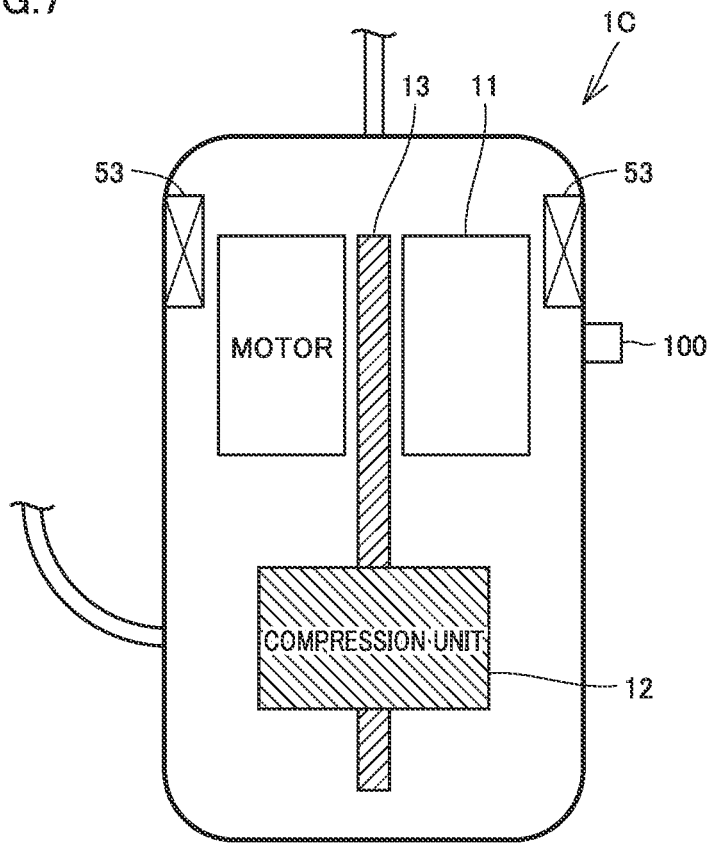
FIG. 7 shows a fourth example of arrangement of the heater.

FIG. 6 shows a third example of arrangement of the heater. In a compressor 1B shown in this third example, heating unit 52 is installed at the upper portion of the motor unit and outside the casing. FIG. 7 shows a fourth example of arrangement of the heater. In a compressor 1C shown in this fourth example, heating unit 53 is installed at the upper portion of the motor unit and inside the casing. The refrigeration oil in the motor unit flows through the motor from the motor upper portion into the motor lower portion. The oil remaining at the motor upper portion is heated in the third and fourth examples.

By reducing the oil viscosity in the motor upper portion, torque for driving the rotating portion of the motor can be reduced, so that effects of improving the reliability and shortening a time of reduced comfort can be obtained. In addition, since the oil at the motor upper portion is the only object to be heated, heat capacity of the object to be heated can be reduced to lower the amount of heating, so that power consumption can be suppressed.

Variation of Heating Control

In the control example shown in FIG. 3, it is assumed that the amount of heating by heating unit 50 is only switched between ON and OFF. However, stopping heating unit 50 after the temperature of the refrigeration oil has actually reached a point equal to or above the pour point means that a transition to the normal control is made after extra heating is performed with respect to the target temperature.

In order to eliminate the extra heating the oil temperature is detected, and when the detected oil temperature is at or below a stored pour point, heating may be performed with an amount of heating calculated from a temperature difference between the detected current temperature and the pour point, and the normal control may be performed when the temperature exceeds the pour point.

Figure 8:
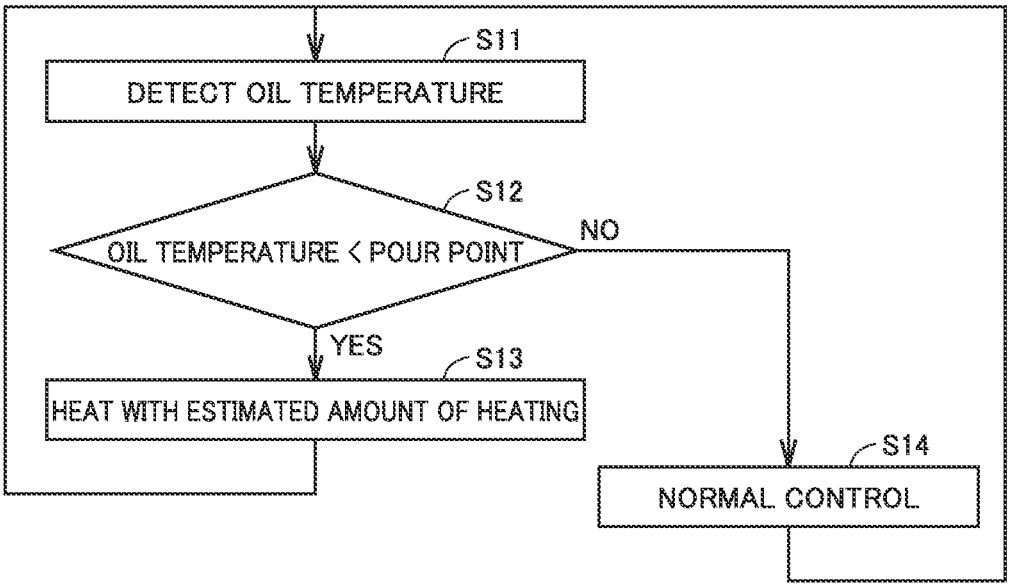
FIG. 8 is a flowchart illustrating a variation of the control performed in the refrigeration cycle apparatus of the first embodiment.

FIG. 8 is a flowchart illustrating a variation of the control performed in the refrigeration cycle apparatus of the first embodiment. The configuration of the refrigeration cycle apparatus is similar to that shown in FIG. 1. First, in step S11, controller 200 causes sensor 100 to detect the oil temperature. Then, in step S12, controller 200 compares the detected temperature of the refrigeration oil and the pour point. When the refrigeration oil temperature<the pour point holds in step S12 (YES in S12), controller 200 estimates an amount of heating, and causes heating unit 50 to perform heating with the estimated amount of heating.

The amount of heating is estimated from the following equation (1) based on a specific heat c [J(g·k)] of the refrigeration oil, a difference ΔT [K] between the current oil temperature and the pour point, an amount of oil m [g], and a time Δt required for oil temperature increase:

$$Q=mc\Delta T/\Delta t \quad (1)$$

Amount of oil m indicates the amount of refrigeration oil held in the compressor. Time Δt indicates the time spent on heating, and is thus determined by relation between the size of the heater and a target heating time. A time that does not make a user feel uncomfortable is stored as the target heating time. At this time, expansion valve 3 may be controlled such that its degree of opening is reduced, for example, in order to facilitate the start of a transition to the normal control.

As described above, in this variation, controller 200 calculates the amount of heat provided to the refrigeration oil from heating unit 50 based on the output from sensor 100 and the pour point of the refrigeration oil.

Using the control of this variation, when the oil temperature is near the pour point, the amount of heating required for temperature increase is suppressed, so that power consumption can be reduced. In addition, when the oil temperature is below and away from the pour point, the time taken for temperature increase can be shortened, so that air conditioning or the like can be started early.

Second Embodiment

While the first embodiment has described an example where the compressor is provided with the heating unit for heating the refrigeration oil, heat generated by the motor (Joule heat) may be used as heating means.

Figure 9:
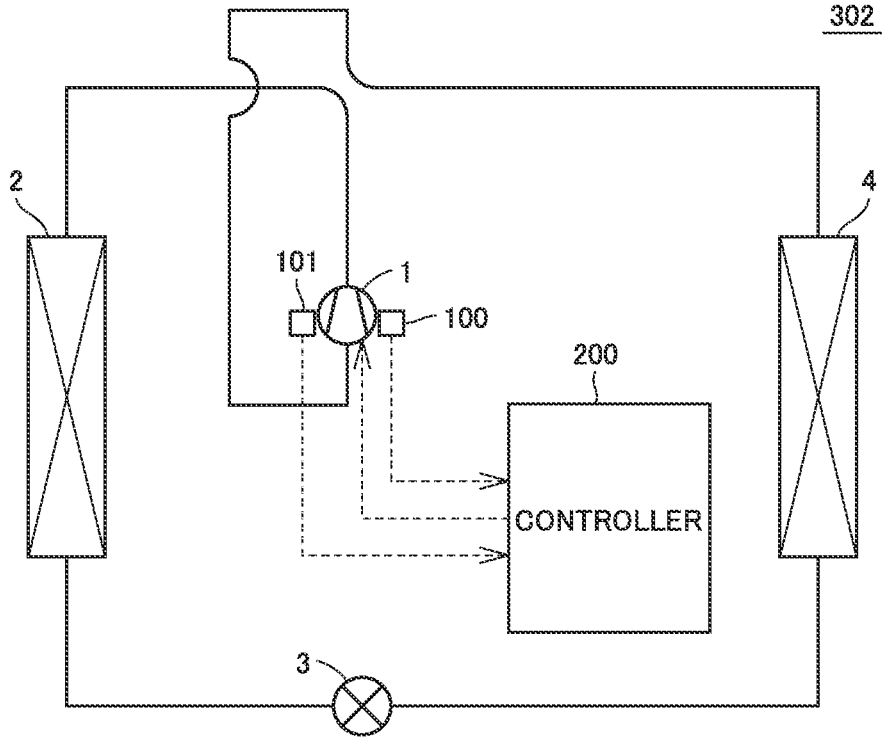
FIG. 9 shows a configuration of a refrigeration cycle apparatus according to a second embodiment.

FIG. 9 shows a configuration of a refrigeration cycle apparatus according to a second embodiment. Referring to FIG. 9, a refrigeration cycle apparatus 302 includes compressor 1, condenser (high-pressure-side heat exchanger) 2, expansion valve (decompressing device) 3, evaporator (low-pressure-side heat exchanger) 4, pour point determination sensor 100, a current sensor 101, and controller 200.

The circulation of the refrigerant and pour point determination sensor 100 are similar to those of the first embodiment, and thus will not be described repeatedly. Current sensor 101 detects a motor current. Based on a detection value detected by pour point determination sensor 100, and a motor current value detected by current sensor 101, controller 200 controls the motor current of compressor 1.

Figure 10:
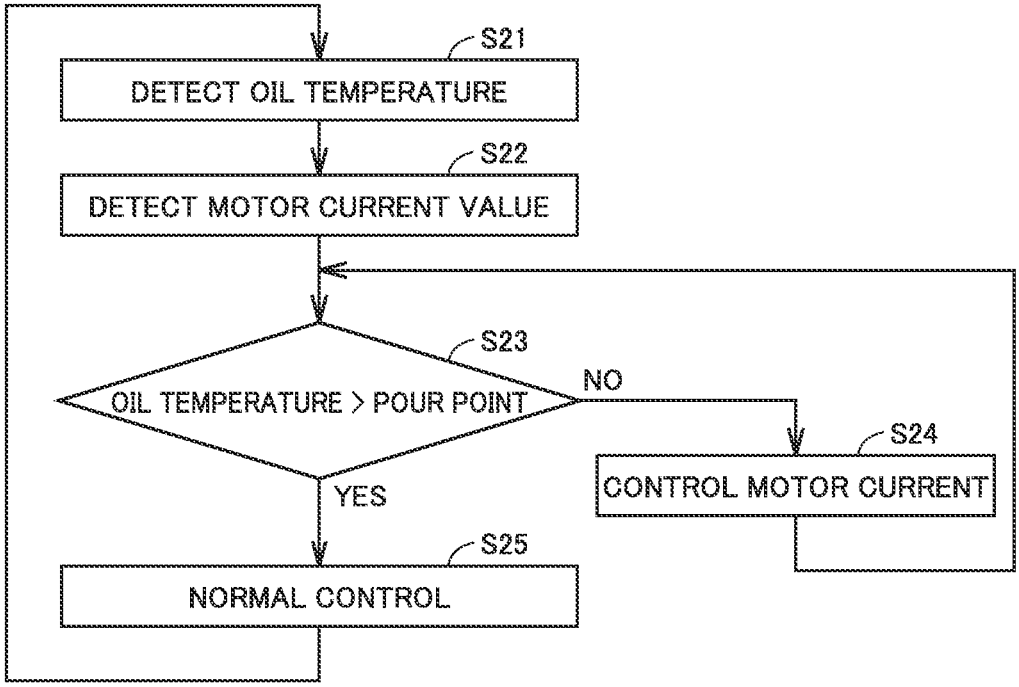
FIG. 10 is a flowchart illustrating control performed in the refrigeration cycle apparatus of the second embodiment.

FIG. 10 is a flowchart illustrating control performed in the refrigeration cycle apparatus of the second embodiment. Referring to FIG. 10, controller 200 detects an oil temperature in step S21, and detects a motor current value in step S22. Then, in step S23, controller 200 determines which of the current oil temperature and the pour point is higher/lower.

When the oil temperature≤the pour point holds in step S23 NO in S23), the process proceeds to step S24, where controller 200 controls the motor current and makes the determination of step S23 again. When the oil temperature>the pour point holds in step S23 (YES in S23), on the other hand, controller 200 performs the normal control, then repeats the process from step S21 again.

Figure 11:
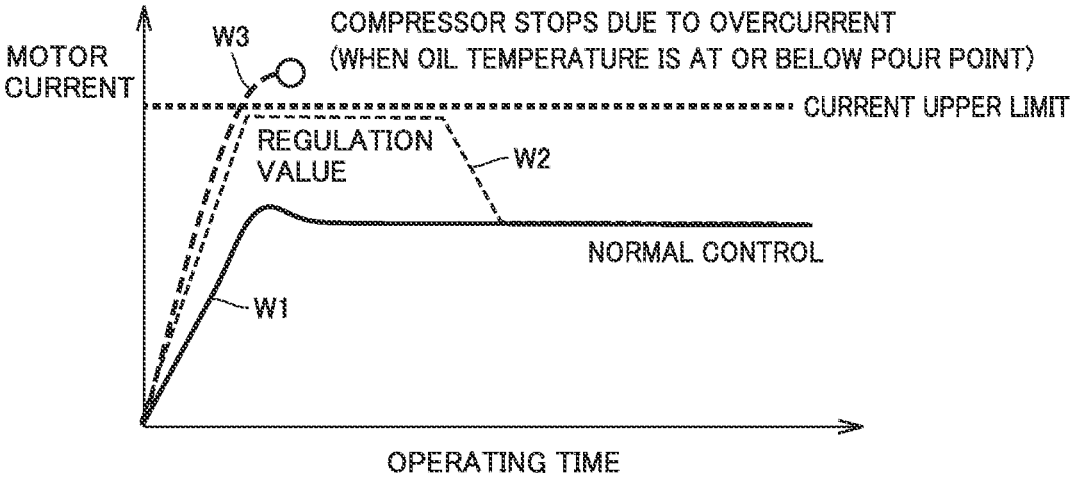
FIG. 11 is a current waveform diagram illustrating control of switching a motor current in the refrigeration cycle apparatus of the second embodiment.

FIG. 11 is a current waveform diagram illustrating control of switching the motor current in the refrigeration cycle apparatus of the second embodiment. The elapse of operating time as well as the flow of refrigerant and oil will be described with reference to FIG. 11. During the normal control when the refrigeration oil temperature is higher than the pour point, controller 200 controls the motor current as indicated by a waveform W1. When rotational resistance of the motor is too high and the motor current exceeds a current upper limit value which causes overcurrent, controller 200 immediately stops the compressor as indicated by a waveform W3. In a refrigeration cycle apparatus configured to operate in this manner, when controller 200 detects that the refrigeration oil temperature is at or below the pour point, controller 200 regulates (limits) the motor current value as indicated by a waveform W2. A value higher than a value during the normal control within a range that does not exceed the current upper limit value is set as a regulation value (limiting value) at this time. Accordingly, the motor current flows through a coil of the motor, and joule heat is generated by a resistance component of the coil, thus heating the refrigeration oil. Thus, the oil temperature is increased and the oil viscosity is reduced. When controller 200 detects that the temperature of the refrigeration oil has reached a point equal to or above the pour point, controller 200 removes the limitation on the current value, and performs the normal control of each actuator (the compressor motor and the expansion valve).

Conventionally, operation at or below the pour point causes overcurrent and a stop of the compressor. In refrigeration cycle apparatus 302 of the second embodiment, the current regulation value is set at or below the overcurrent, so that a stop of the compressor does not occur.

In contrast, refrigeration cycle apparatus 302 uses the coil, of the motor of compressor 1 as a heating unit, and further includes current sensor 101 to detect a current flowing in the coil.

Controller 200 is configured to stop the motor when the output from current sensor 101 exceeds an overcurrent threshold value. In addition, when the temperature detected by sensor 100 is higher than the pour point of the refrigeration oil, the controller controls the motor by setting a first current value as the target value of the current flowing in the coil, and when the temperature detected by the detection unit is lower than the pour point of the refrigeration oil, the controller controls the motor by setting a second current value higher than the first current value and lower than the overcurrent threshold value as the target value.

In refrigeration cycle apparatus 302 of the second embodiment, the oil temperature can be increased without using additional heating means such as a heater.

Since the current value is limited, a stop of the compressor due to overcurrent is suppressed, and reduction in comfort can be suppressed.

First Variation of Second Embodiment

In the second embodiment, the regulation value can be determined by a similar idea to that of the control shown in FIG. 8.

In this case, controller 200 estimates a regulation value of the motor current based on the detection value of the oil temperature and the pour point. Then, based on the estimated regulation value and the detection value, controller 200 controls the motor current and each actuator (for example, the operating frequency of the compressor, the degree of opening of the expansion valve, and the like).

The amount of heating is estimated from the following equation (2) based on a specific heat c [J/(g·k)] of the refrigeration oil, a difference ΔT [K] between the current oil temperature and the target oil temperature (for example, the pour point), an amount of oil m [g], a resistance value R of the motor coil, and a time Δt required for oil temperature increase:

$$I=\sqrt{(mc\Delta T/R)}/\Delta t \quad (2)$$

When a current value I calculated from the equation (2) is below the current upper limit value, controller 200 sets current value I as the regulation value. When current value I is equal to or higher than the current upper limit value, controller 200 sets the current upper limit value (for example, a current value during overcurrent protection control) as the regulation value.

In the first variation of the second embodiment, by employing a variable regulation value for increasing the temperature of the refrigeration oil, and limiting the motor current to a required current value, the power consumption can be reduced.

Third Embodiment

Figure 12:
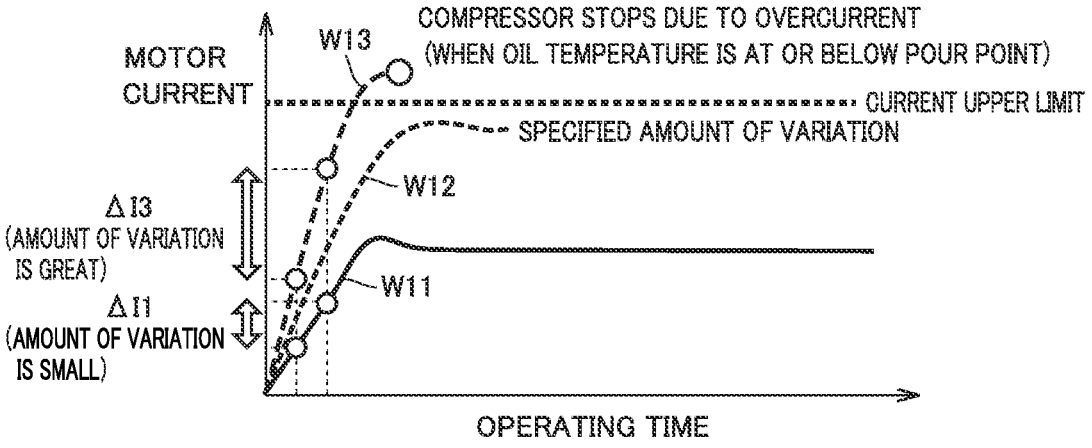
FIG. 12 is a current waveform diagram illustrating basic operation of a refrigeration cycle apparatus of a third embodiment.

A third embodiment describes estimating the oil viscosity from an amount of variation in the motor current value. FIG. 12 is a current waveform diagram illustrating basic operation of a refrigeration cycle apparatus of the third embodiment.

When the oil viscosity is high, the motor current value increases. An amount of this variation is greater than an amount of normal variation. A waveform W12 indicates a current waveform in which an amount of variation (current increase rate) determined by relation between the operating time and the motor current is a specified amount of variation. In this case, there could be cases where the amount of variation is smaller than the specified amount of variation as indicated by waveform W11 (waveform W11), and where the amount of variation is greater than the specified amount of variation (waveform W13).

When the amount of variation is greater than the specified amount of variation, the compressor stops due to overcurrent as indicated by waveform W13. The temperature of the refrigeration oil at this time is lower than the pour point. When the amount of variation is smaller than the specified amount of variation as indicated by waveform W11, on the other hand, the motor current does not reach the upper limit value, and normal operation can be performed. Using this relation, the viscosity of the refrigeration oil can be estimated by monitoring the motor current value, instead of by monitoring the temperature of the refrigeration oil.

Figure 13:
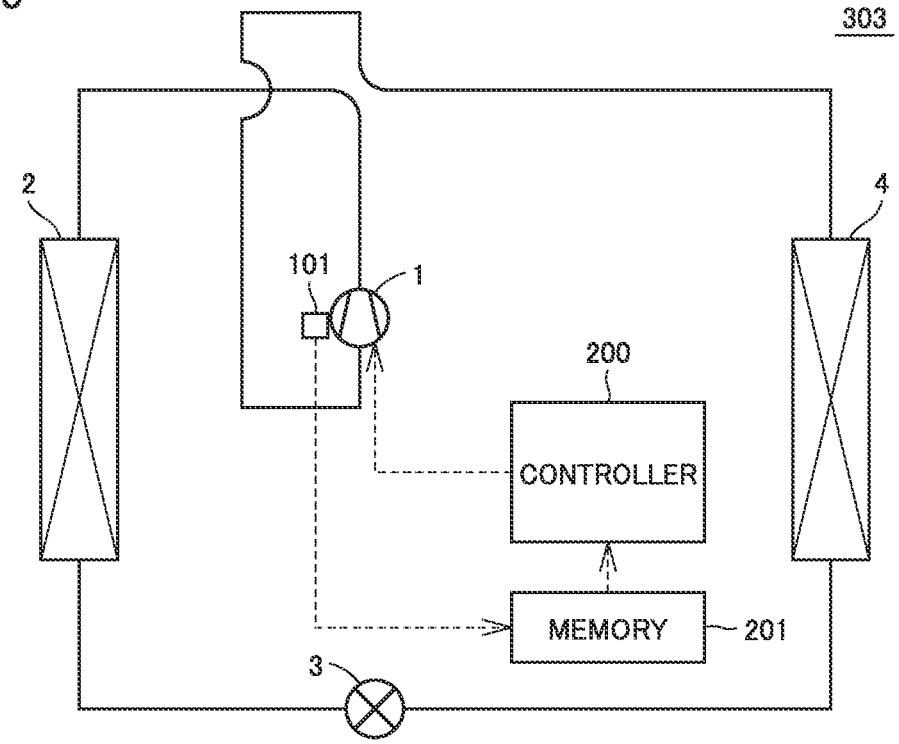
FIG. 13 shows a configuration of the refrigeration cycle apparatus according to the third embodiment.

FIG. 13 shows a configuration of the refrigeration cycle apparatus according to the third embodiment. Referring to FIG. 13, a refrigeration cycle apparatus 303 includes compressor 1, condenser (high-pressure-side heat exchanger) 2, expansion valve (decompressing device) 3, evaporator (low-pressure-side heat exchanger) 4, current sensor 101, controller 200, and a memory 201. Pour point determination sensor 100 is not provided in the configuration of FIG. 13.

The circulation of the refrigerant is similar to that of the first embodiment, and thus will not be described repeatedly. Current sensor 101 detects a motor current. Memory 201 stores a detection value from current sensor 101.

Based on the detection value from current sensor 101 and a current value stored in memory 201, controller 200 calculates a difference in the motor current or an amplification amount of an integrated value. Furthermore, controller 200 estimates an amount of variation in the current value from the calculated value, and based on the estimated value of the amount of variation and the specified amount of variation, controls the motor current or the heating means and each actuator (for example, the operating frequency of the compressor, the degree of opening of the expansion valve, and the like).

For example, when the amount of variation in the current flowing in the motor is smaller than the specified amount of variation (first amount of variation), the controller sets the first current value as the target value, and when the amount of variation in the current flowing in the motor is greater than the first amount of variation, the controller sets the second current value higher than the first current value and lower than the overcurrent threshold value as the target value.

Figure 14:
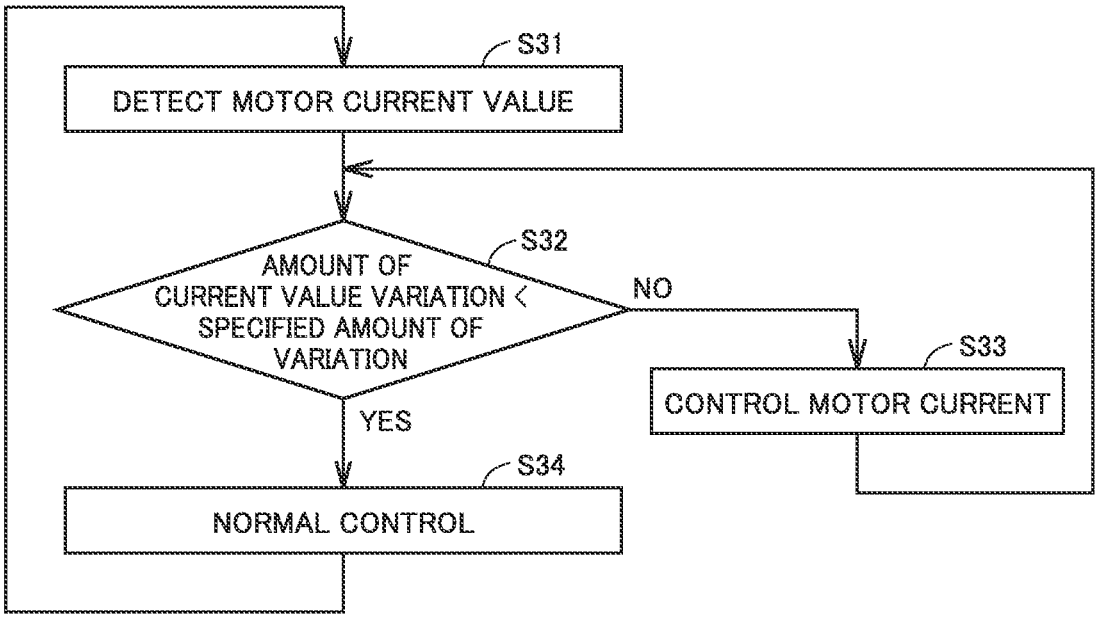
FIG. 14 is a flowchart illustrating control performed in the refrigeration cycle apparatus of the third embodiment.

FIG. 14 is a flowchart illustrating control performed in the refrigeration cycle apparatus of the third embodiment. In step S31, controller 200 detects a motor current value. Then, in step S32, controller 200 determines which of an amount of variation in the motor current value and a specified amount of variation is higher/lower. When the amount of variation in the motor current value≥the specified amount of variation holds in step S32 (NO in S32), controller 200 controls the motor current to heat the refrigeration oil in step S33, and makes the determination of step S32 again.

The control of the motor current includes several stages. When the amount of variation in the current value is greater than the specified amount of variation (NO in S32), a command value (target value) of the motor current is initially set as the current regulation value. When the amount of current variation is still greater than the specified amount of variation after the motor current is set as the regulation value, and this condition continues for a specified time or longer, controller 200 stops the compressor.

When the amount of variation<the specified amount of variation bolds in step S32 (YES in S32), on the other hand, controller 200 causes the process to proceed to step S34 and performs the normal control of the compressor, then repeats the process from step S31.

According to the refrigeration cycle apparatus of the third embodiment, even when the oil viscosity in the compressor is increased due to some effect, which is not limited to low temperature, reduced comfort and reduced reliability such as an abnormal stop of the compressor or compressor failure can be prevented by limiting the motor current. In addition, even without a temperature sensor, a concentration sensor and the like, an abnormal stop of the compressor or compressor failure can be avoided by limiting the motor current depending on the operating condition of the compressor, so that reduced comfort and reduced reliability can be prevented even in the case of failure of the sensor or the like.

Fourth Embodiment

Figure 15:
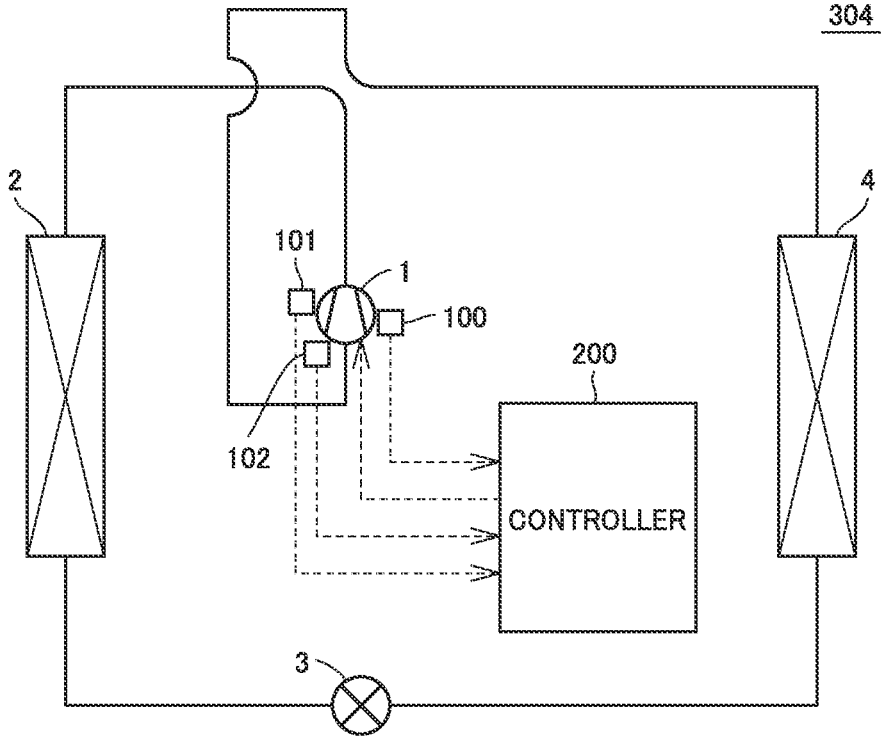
FIG. 15 shows a configuration of a refrigeration cycle apparatus according to a fourth embodiment.

A fourth embodiment describes an example where the oil concentration in the compressor is detected and used for control. FIG. 15 shows a configuration of a refrigeration cycle apparatus according to the fourth embodiment. Referring to FIG. 15, a refrigeration cycle apparatus 304 includes compressor 1, condenser (high-pressure-side heat exchanger) 2, expansion valve (decompressing device) 3, evaporator (low-pressure-side heat exchanger) 4, pour point determination sensor 100, current sensor 101, an oil concentration sensor 102, and controller 200.

The circulation of the refrigerant and pour point determination sensor 100 are similar to those of the first embodiment, and current sensor 101 is similar to that of the third embodiment, and thus will not be described repeatedly. Oil concentration sensor 102 detects the concentration of the refrigeration oil in the compressor.

In the first embodiment, the oil concentration is not detected, and therefore, the pour point is set as temperature T3 under the most stringent condition in FIG. 2. In contrast, in the fourth embodiment, the oil concentration is detected by oil concentration sensor 102, so that the pour point can be switched between T2 and T1 in FIG. 2 depending on the oil concentration.

In addition, the heat capacity and the viscosity used in the equation (1) of the first embodiment and the equation (2) of the second embodiment can be estimated from the oil concentration and the oil temperature, and when the oil temperature is at or below the pour point, heating can be performed with a more accurately required current value and amount of heating. The viscosity can be estimated by storing the graph of the relation shown in FIG. 2. The heat capacity can be estimated by storing temperature increase caused by heating, and using a specific heat and the temperature increase.

That is, controller 200 calculates the amount of heat provided to the refrigeration oil based on the output from sensor 100, the pour point, and the output from concentration sensor 100.

The refrigeration cycle apparatus of the fourth embodiment can more accurately calculate the amount of heating required for oil temperature increase and perform heating with a corresponding heater current value or motor current value, thereby suppressing power consumption. In addition, by detecting the oil concentration, both the viscosity and the amount of existing oil can be detected, so that the reliability of the compressor can be improved.

Fifth Embodiment

The first to fourth embodiments described above mainly examine the fluidity of the refrigeration oil in the compressor. However, when the temperature not only in the compressor but also in the low-pressure-side elements (the evaporator, the pipe and the like) is at or below the pour point, the following problems occur.

First, the temperature in the pipe and the heat exchanger on the low pressure side reaches a point equal to or below the pour point, making it difficult for the oil to flow. As a result, a large amount of oil remains in the low-pressure-side elements, resulting in reduced reliability due to depletion of the oil in the compressor. Second, a large amount of oil remains in the pipe of the low-pressure-side heat exchanger, resulting in reduced heat exchange performance due to reduced heat transfer performance and increased pressure drop in the pipe.

In a fifth embodiment, therefore, a two-phase pipe temperature on the low pressure side is detected, and, when the temperature is at or below the pour point, the pressure or the temperature of refrigerant to be flown after the elapse of a certain period of time is increased.

Figure 16:
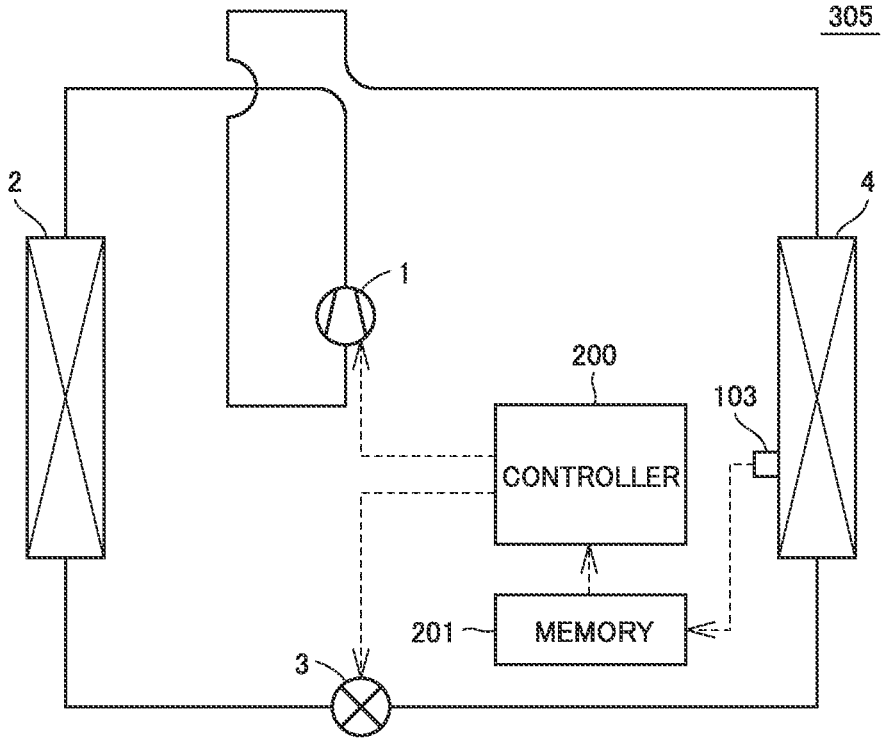
FIG. 16 shows a configuration of a refrigeration cycle apparatus according to a fifth embodiment.

FIG. 16 shows a configuration of a refrigeration cycle apparatus according to the fifth embodiment. Referring to FIG. 16, a refrigeration cycle apparatus 305 includes compressor 1, condenser (high-pressure-side heat exchanger) 2, expansion valve (decompressing device) 3, evaporator (low-pressure-side heat exchanger) 4, a pour point determination sensor 103 (for example, a pipe temperature sensor), controller 200, and memory 201.

The circulation of the refrigerant is similar to that of the first embodiment, and thus will not be described repeatedly. Current sensor 101 detects a motor current. Memory 201 stores a detection value from current sensor 101. Pour point determination sensor 103 can detect that the temperature of the low-pressure-side heat exchanger (evaporator 4) reaches a point equal to or below the pour point. Memory 201 stores a period of time during which the temperature of the low-pressure system has been at or below the pour point. When controller 200 detects that the period of time during which the temperature of the low-pressure system has been at or below the pour point is equal to or longer than a specified time, controller 200 controls each actuator. Any actuator is available as long as it increases the temperature of the refrigeration oil. For example, when the low-pressure-side heat exchanger is an air heat exchanger, the temperature within the low-pressure-side heat exchanger can be increased by increasing a fan rotating speed. When the low-pressure-side heat exchanger is a water heat exchanger, the temperature within the low-pressure-side heat exchanger can be increased by increasing a water flow rate. Alternatively, the pressure of the low-pressure unit can be increased, such as by increasing the degree of opening of the decompressing device, or by reducing the compressor frequency.

Figure 17:
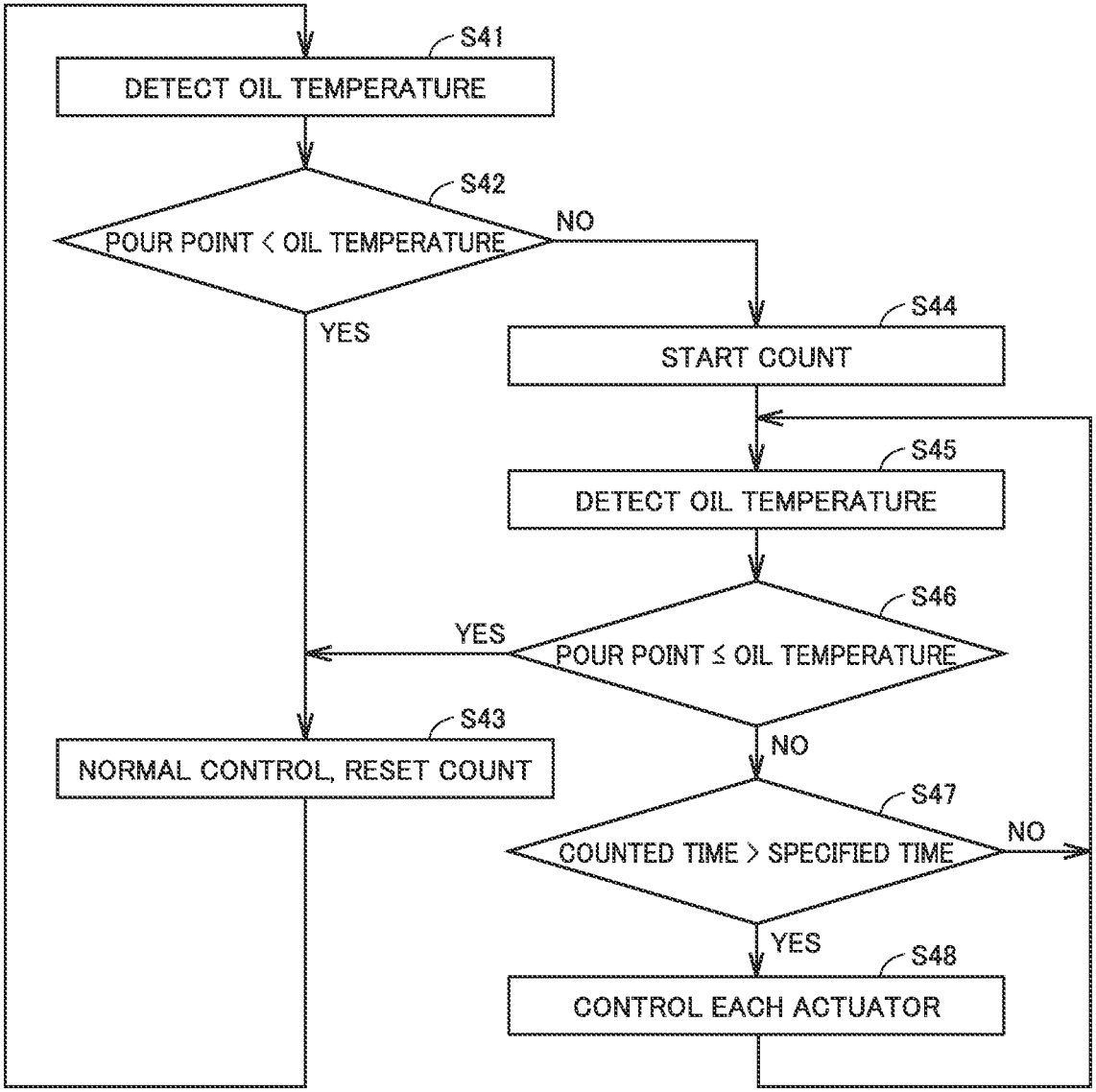
FIG. 17 is a flowchart illustrating control performed in the refrigeration cycle apparatus of the fifth embodiment.

FIG. 17 is a flowchart illustrating control performed in the refrigeration cycle apparatus of the fifth embodiment. Referring to FIG. 17, first, in step S41, controller 200 causes sensor 103 to detect the temperature in the low-pressure-side heat exchanger. Then, in step S42, controller 200 determines which of the pour point and the current oil temperature is higher/lower.

When the oil temperature≤the pour point holds in step S42 (NO in S42), controller 200 starts to count a time in step S44. Then, in step S45, controller 200 causes sensor 103 to detect the temperature in the low-pressure-side heat exchanger. Furthermore, in step S46, controller 200 determines which of the counted time and a specified time is longer/shorter.

When the pour point>the oil temperature holds in step S46 (NO in S46), controller 200 compares the counted time and the specified time in step S47. When the counted time>the specified time does not hold in step S47, the process returns to step S45 again. When the counted time>the specified time holds in step S47, on the other hand, controller 200 controls each actuator so as to increase the temperature of the low-pressure-side heat exchanger in step S48.

When the current oil temperature is at or above the pour point in step S42 or S46, the process proceeds to step S43, where controller 200 performs the normal control and resets the time count, then repeats the process from step S41.

According to the refrigeration cycle apparatus of the fifth embodiment, an increase in the oil viscosity in the low-pressure-side heat exchanger which causes a large amount of oil to remain in the low-pressure-side heat exchanger can be prevented, so that reduced performance and reduced compressor reliability can be suppressed.

Sixth Embodiment

When the refrigeration cycle apparatus is provided with a switch valve (for example, a four-way valve) to switch between the high-pressure-side heat exchanger and the low-pressure-side heat exchanger, once the temperature of the refrigeration oil reaches a point equal to or below the pour point, switching can be made between the high-pressure-side heat exchanger and the low-pressure-side heat exchanger, to thereby increase the oil temperature in the low-pressure-side heat exchanger.

Figure 18:
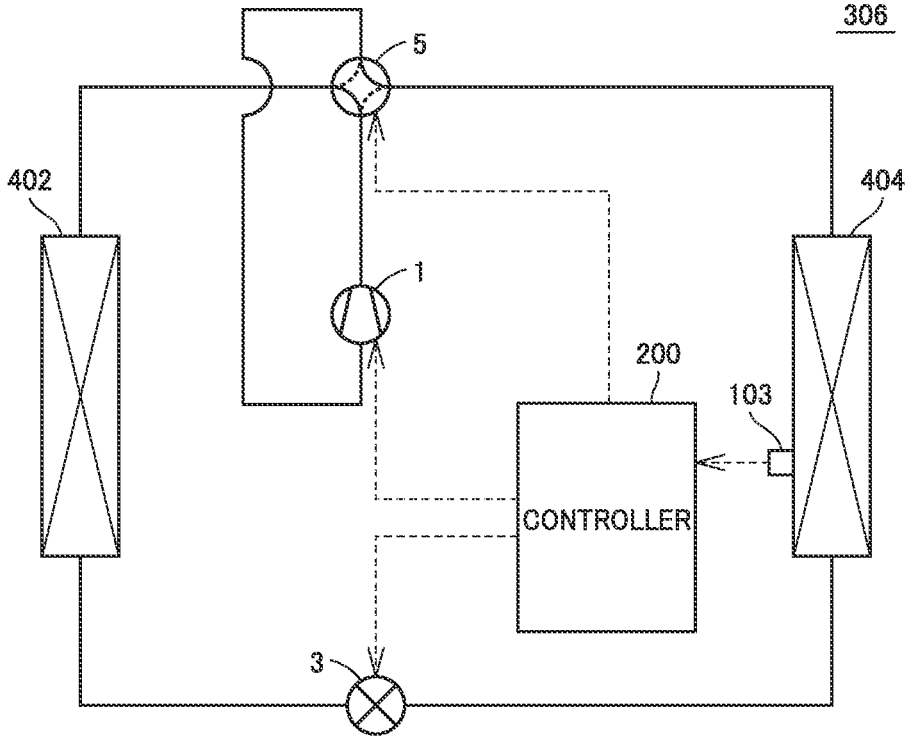
FIG. 18 shows a configuration of a refrigeration cycle apparatus according to a sixth embodiment.

FIG. 18 shows a configuration of a refrigeration cycle apparatus according to a sixth embodiment. Referring to FIG. 18, a refrigeration cycle apparatus 306 is a refrigeration cycle apparatus in which refrigerant circulates successively through compressor 1, a condenser, expansion valve 3, and an evaporator. The condenser is one of a first heat exchanger 402 and a second heat exchanger 404, and the evaporator is the other of first heat exchanger 402 and second heat exchanger 404. Refrigeration cycle apparatus 306 includes a switch valve 5, a temperature sensor 103, and controller 200.

Switch valve 5 is configured to switch between a first circulation state in which first heat exchanger 402 is operated as the condenser and second heat exchanger 404 is operated as the evaporator, and a second circulation state in which first heat exchanger 402 is operated as the evaporator and second heat exchanger 404 is operated as the condenser.

Temperature sensor 103 detects the temperature of the refrigerant flowing in the heat exchanger operating as the evaporator. In the case of FIG. 18, temperature sensor 103 detects the temperature of the refrigerant flowing in the evaporator in the aforementioned second circulation state in which second heat exchanger 404 works as the evaporator. It should be noted that first heat exchanger 402 may be provided with another temperature sensor, to detect the temperature of the refrigerant flowing in the evaporator in the aforementioned first circulation state.

When the refrigerant temperature detected by temperature sensor 103 is lower than the pour point of the refrigeration oil, controller 200 controls switch valve 5 such that switch valve 5 is switched for a specified time and then returned to its original state.

Figure 19:
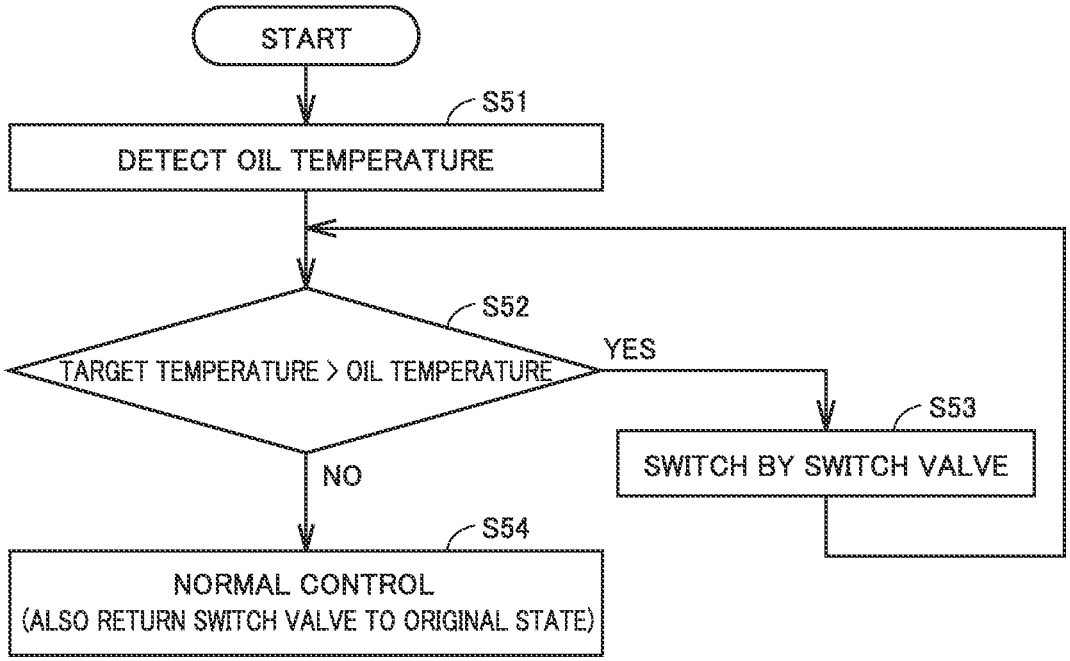
FIG. 19 is a flowchart illustrating control performed in the refrigeration cycle apparatus of the sixth embodiment.

FIG. 19 is a flowchart illustrating control performed in the refrigeration cycle apparatus of the sixth embodiment. Referring to FIG. 19, in step S1 during startup, controller 200 causes temperature sensor 103 to detect the temperature of the refrigeration oil (refrigerant temperature) in a pipe of second heat exchanger 404. Then, in step S52, controller 200 compares the current temperature of the refrigeration oil and a target temperature (pour point).

When the current temperature of the refrigeration oil is lower than the pour point in step S52, the process proceeds to step S53, where switching of a flow direction of the refrigerant is made by switch valve 5. After the switching, in the normal control, the high-temperature and high-pressure refrigerant discharged from compressor 1 flows into second heat exchanger 404, passes through the expansion valve and first heat exchanger 402, and returns to compressor 1.

As a result, the high-temperature and high-pressure refrigerant discharged from compressor 1 flows into second heat exchanger 404, causing an increase in the pipe temperature of second heat exchanger 404. The determination of step S52 is repeatedly performed in this state, and controller 200 operates compressor 1 until the detected temperature reaches a temperature equal to or above the target temperature. When the current temperature of the refrigeration oil is equal to or above the target temperature in step S52 (NO in S52), controller 200 returns switch valve 5 to normal control (original state) in step S54. In the normal control, the high-temperature and high-pressure refrigerant discharged from compressor 1 flows into first heat exchanges 402, is decompressed at expansion valve 3, passes through second heat exchanger 404 and returns to compressor 1.

It should be noted that the process of FIG. 19 is performed once at the start of operation of the refrigeration cycle apparatus. The target temperature at this time is the pour point of the refrigeration oil. The pour point, which varies with the type or concentration of refrigeration oil, is −37.5° C. at a very low temperature and for Daphne Hermetic Oil (registered trademark), for example. It is also conceivable that defrost operation occurs and switch valve 5 is similarly switched during the normal operation of S54 as well. A switching temperature at this time is higher than the pour point of the refrigeration oil, and is about 0° C. in the vicinity of the freezing point of water, for example.

When the temperature of the low-pressure-side heat exchanger reaches a point equal to or below the pour point, the oil viscosity in the low-pressure-side heat exchanger is increased and a large amount of oil remains, resulting in reduced performance and reduced reliability such as depletion of the oil in the compressor. In the sixth embodiment, the temperature of the low-pressure-side heat exchanger is controlled so as to reach a point equal to or above the pour point, so that reduced performance of the refrigeration cycle apparatus and reduced compressor reliability can be suppressed.

It should be understood that the embodiments disclosed herein are illustrative and non-restrictive in every respect. The scope of the present invention is defined by the terms of the claims, not the description of the embodiments above, and is intended to include any modifications within the meaning and scope equivalent to the terms of the claims.

REFERENCE SIGNS LIST

1, 1A, 1B, 1C compressor; 2 condenser; 3 expansion valve; 4 evaporator; 5 switch valve; 11 motor; 12 compression unit; 50 heating unit; 100, 103 pour point determination sensor; 101 current sensor; 102 oil concentration sensor; 200 controller; 201 memory; 301 to 306 refrigeration cycle apparatus; 402 first heat exchanger; 404 second heat exchanger.

The invention claimed is:

1. A refrigeration cycle apparatus in which refrigerant circulates successively through a compressor, a condenser, an expansion valve, and an evaporator, the refrigeration cycle apparatus comprising:

a temperature sensor configured to detect a temperature of refrigeration oil in the compressor;

a heater configured to heat the refrigeration oil; and a controller configured to operate the heater when the temperature detected by the temperature sensor is lower than a pour point of the refrigeration oil, and to stop the heating by the heater when the temperature detected by the temperature sensor reaches the pour point, wherein the compressor includes a pump unit, a motor unit that drives the pump unit, and a casing that contains the pump unit and the motor unit, the motor unit is located above the pump unit, and the heater is provided outside or inside the casing so as to be located at a level higher or equal to the motor unit.

2. The refrigeration cycle apparatus according to claim 1, wherein the controller is configured to calculate an amount of heat provided to the refrigeration oil from the heater based on output from the temperature sensor and the pour point.

3. The refrigeration cycle apparatus according to claim 1, wherein the heater includes a coil of a motor of the compressor as a heat generation unit, the refrigeration cycle apparatus further comprises a current sensor configured to detect a current flowing in the coil, the controller is configured to stop the motor when output from the current sensor exceeds an overcurrent threshold value, and the controller is configured to:

when the temperature detected by the temperature sensor is higher than the pour point of the refrigeration oil, control the motor by setting a first current value as a target value of the current flowing in the coil; and when the temperature detected by the temperature sensor is lower than the pour point of the refrigeration oil, control the motor by setting a second current value higher than the first current value and lower than the overcurrent threshold value as the target value.

4. The refrigeration cycle apparatus according to claim 3, wherein the controller is configured to determine the second current value depending on output from the temperature sensor.

5. The refrigeration cycle apparatus according to claim 3, wherein the controller is configured to:

when an amount of variation in a current flowing in the motor is smaller than a first amount of variation, set the first current value as the target value; and when the amount of variation in the current flowing in the motor is greater than the first amount of variation, set the second current value as the target value.

6. The refrigeration cycle apparatus according to claim 1, further comprising a concentration sensor configured to detect a concentration of the refrigeration oil in a mixture of liquid refrigerant and the refrigeration oil within the compressor, wherein the controller is configured to calculate an amount of heat provided to the refrigeration oil from the heater based on output from the temperature sensor, the pour point and output from the concentration sensor.

* * * * *